US006660668B2

(12) United States Patent
Tanabe et al.

(10) Patent No.: US 6,660,668 B2
(45) **Date of Patent: *Dec. 9, 2003**

(54) WOVEN WEBBING STRUCTURE

(75) Inventors: Masahiro Tanabe, Aichi-ken (JP); Yasuma Tominaga, Aichi-ken (JP); Akira Nagawa, Niigata-ken (JP)

(73) Assignees: Kabushiki Kaisha Tokai-Rika-Denki-Seisakusho (JP); Hoshino Kogyo Kabushiki Kaisha (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/468,322

(22) Filed: Dec. 21, 1999

(65) Prior Publication Data

US 2002/0142687 A1 Oct. 3, 2002

(30) Foreign Application Priority Data

Dec. 24, 1998 (JP) ..... 10-367389

(51) Int. Cl.[7] ..... D03D 15/10; D03D 11/00

(52) U.S. Cl. ..... 442/206; 442/190; 442/205; 442/207; 139/413; 139/414; 139/415

(58) Field of Search ..... 442/190, 203, 442/205, 206, 208, 209, 207; 428/373; 139/413, 414, 415, 408

(56) References Cited

U.S. PATENT DOCUMENTS 3,872,895 A * 3/1975 Takada ..... 139/383 R
3,957,090 A * 5/1976 Muhlen et al. ..... 139/409
3,965,943 A * 6/1976 Goff, Jr. et al. ..... 139/421
4,839,220 A * 6/1989 Stijntjes et al. ..... 428/258
5,514,457 A * 5/1996 Fels et al. ..... 428/373

FOREIGN PATENT DOCUMENTS

| | | |
|---|---|---|
| JP | 49-29617 | 3/1974 |
| JP | 53-1874 | 1/1978 |
| JP | 53-154274 | 12/1978 |

OTHER PUBLICATIONS

Dictionary of Fiber & Textile Technology. KOSA. 1999. p. 228.*

Kadolph, Sara J. and Langford, Anna L. Textiles Eight Edition. Prentice–Hall, Inc., New Jersey. 1998. p. 144.*

Tortora, Phyliss. Understanding Textiles. Macmillian Publishing Company, New York, New York. 1992. pp 188, 196.*

Notice of Reasons for Rejection (Dated Apr. 22, 2003) With Translation.

* cited by examiner

*Primary Examiner*—Cheryl A. Juska
*Assistant Examiner*—Jenna-Leigh Befumo
(74) *Attorney, Agent, or Firm*—Nixon Peabody LLP; Thomas W. Cole

(57) ABSTRACT

There is disclosed a woven webbing structure, which resists interwoven yarns from coming out from the surface of the webbing due to bending, or the like. This is achieved without any significant reduction in the strength or energy absorptivity of the webbing. The webbing includes warps that each have a cored yarn and a side yarn, and wefts interwoven therein. The cored yarn is set such that the elongation percentage thereof is smaller than, or the extensional rigidity thereof is larger than, that of the side yarn, and is twisted by single twisting or the like. As a result, unevenness is formed on the surface of the cored yarn and friction between the cored yarn and other yarns, that is, the side yarn or the weft increases. The frictional force between yarns functions for resisting free movement of the cored yarn due to bending of the webbing, thereby making it possible for the cored yarn to resist coming out from the surface of the webbing.

15 Claims, 4 Drawing Sheets

WOVEN WEBBING STRUCTURE

BACKGROUND OF THE INVENTION

1. Field of the Invention

The present invention relates generally to webbing, and in particular to woven webbing structures for vehicle occupant restraining used in a vehicle seat belt device.

2. Description of the Related Art

An example of a vehicle seat belt device is a three point seat belt type using a continuous webbing.

In this type of seat belt device, one end of the webbing is fastened to a take-up mechanism and another end of the webbing is fastened to an anchor plate via a through anchor. In order to apply the webbing to a vehicle occupant, a tongue plate provided at an intermediate portion of the webbing between the anchor plate and the through anchor is engaged with a buckle device and the webbing is thereby pulled out from the take-up device.

A type of webbing used in the above-described seat belt device is known as so-called energy absorbing webbing, which has a function of reducing (absorbing) energy that acts on a vehicle occupant at the time of sudden deceleration of a vehicle. This type of webbing is comprised of different kinds of yarns running along a longitudinal direction of the webbing and having different elongation percentages or different extensional rigidities. For example, the warps are formed by cored yarns whose elongation percentage is relatively small or whose extensional rigidity is relatively large, along with side yarns having a large elongation percentage or a small extensional rigidity.

As a result, when a large load acts on the webbing, the cored yarns are broken earlier than the side yarns and absorb the load, thereby reducing energy applied to the vehicle occupant.

In such a type of conventional energy absorbing webbing, it is thus possible to reduce energy acting on the vehicle occupant due to the cored yarns being broken and absorbing the load. However, the cored yarns interwoven within the webbing come out from the surface of the webbing due to friction caused by the webbing sliding on the through anchor or the anchor plate, or bending of the webbing caused by applying the webbing to the vehicle occupant. As a result, the yarns fray, or deterioration in appearance occurs.

SUMMARY OF THE INVENTION

In view of the above-described facts, an object of the present invention is to provide a woven webbing structure, in which the risk of (often referred to herein as "webbing" for convenient reference) interwoven cored yarns coming out from a surface of the webbing due to friction caused by the webbing sliding on a through anchor, or bending of the webbing caused by applying the webbing to a vehicle occupant, is reduced. The advantage thereof is to thereby prevent occurrence of frayed yarns or deterioration in appearance. It is intended to achieve these effects without significantly reducing strength or energy absorptivity of the webbing.

A woven webbing structure according to the present invention comprises plural types of warps interwoven along a longitudinal direction of the webbing and having different elongation percentages or extensional rigidities, and wefts interwoven along a transverse direction with respect to the warps. In this woven webbing structure, among the plural kinds of warps, there is at least one kind of warp whose elongation percentage is relatively small or extensional rigidity is relatively large, and which has been subjected to twist processing.

In the woven webbing structure according to the present invention, the warps interwoven along the longitudinal direction of the webbing each include plural kinds of yarns having different elongation percentages or extensional rigidities. Among these warps, a yarn whose elongation percentage is relatively small or extensional rigidity is relatively large has been subjected to twist processing.

The above-described webbing is used in, for example, a vehicle safety restraint belt device. When a large load acts on the webbing, the yarn whose elongation percentage is relatively small or extensional rigidity is relatively large among the warps breaks earlier than other yarns and absorbs the load, thereby reducing energy that would act on the vehicle occupant.

Further, in the woven webbing structure according to the present invention, the warp whose elongation percentage is relatively small or extensional rigidity is relatively large has been subjected to twist processing. Therefore, unevenness is formed on the surface of this warp and friction between this yarn and other yarns (other warps or wefts) increases. The frictional force functions for preventing free movement of the twisted warp due to bending of the webbing, or the like. Accordingly, even if the webbing is bent by friction due to the webbing sliding on a through anchor or applying the webbing to a vehicle occupant, the above-described twisted warp resists coming out from the surface of the webbing.

Particularly, when plural kinds of warps having different thicknesses are subjected to twisting processing (for example, when two kinds of warps having different thicknesses are twisted together), the entire surface of these warps is made uneven still more so as to further increase the frictional force between yarns, which is even more effective.

As described above, in the woven webbing structure according to the present invention, there is reduced possibility that the interwoven yarns will come out from the surface of the webbing due to bending of the webbing, or the like, such as when the webbing is applied to a vehicle occupant. As a result, fraying of yarns and deterioration in appearance is reduced, and is achieved without any significant reduction in the strength and energy absorptivity of the webbing.

Further, according to another aspect of the present invention, in the above-described woven webbing structure, the warp is subjected to single twisting or plying and is set such that a twist coefficient thereof, K, is at least 1200, where the number of twists per meter is T, the denier number of the warp is D, and the twist coefficient defined by $$T\sqrt{D} \text{ is } K.$$

When the twist coefficient K is set as described above, friction between yarns due to surface unevenness of the warp increases in rapid proportion to K, so that the warp resists coming out from the surface of the webbing.

BRIEF DESCRIPTION OF THE DRAWINGS

FIG. 1 is a longitudinal cross-sectional view taken along the line 1—1 in FIG. 2, wherein

FIG. 2 is a plan view of webbing according to a first preferred embodiment of the present invention.

DESCRIPTION OF THE PREFERRED EMBODIMENTS

Figure 1:
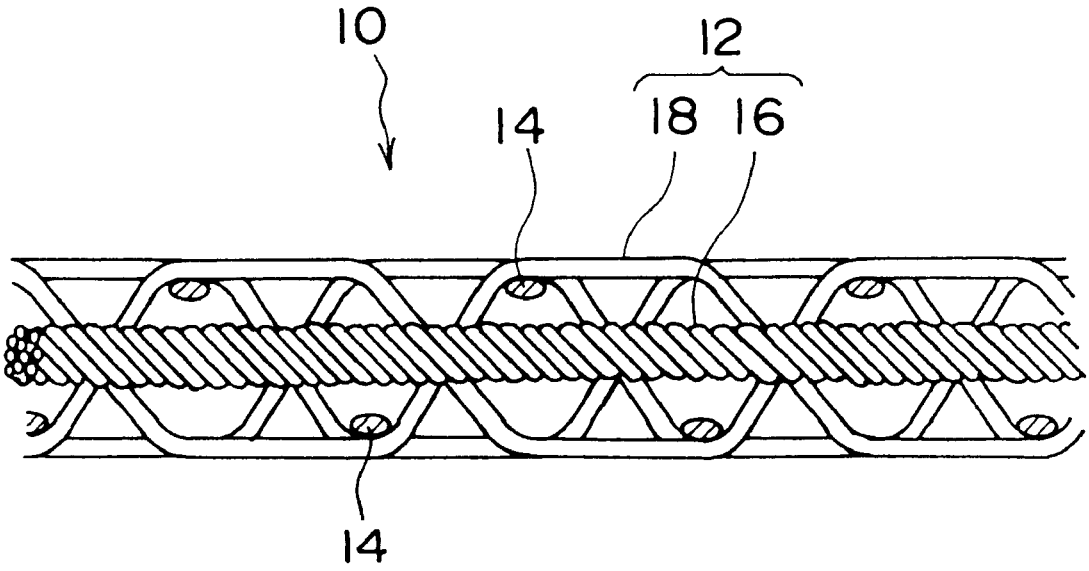
Figure 2:
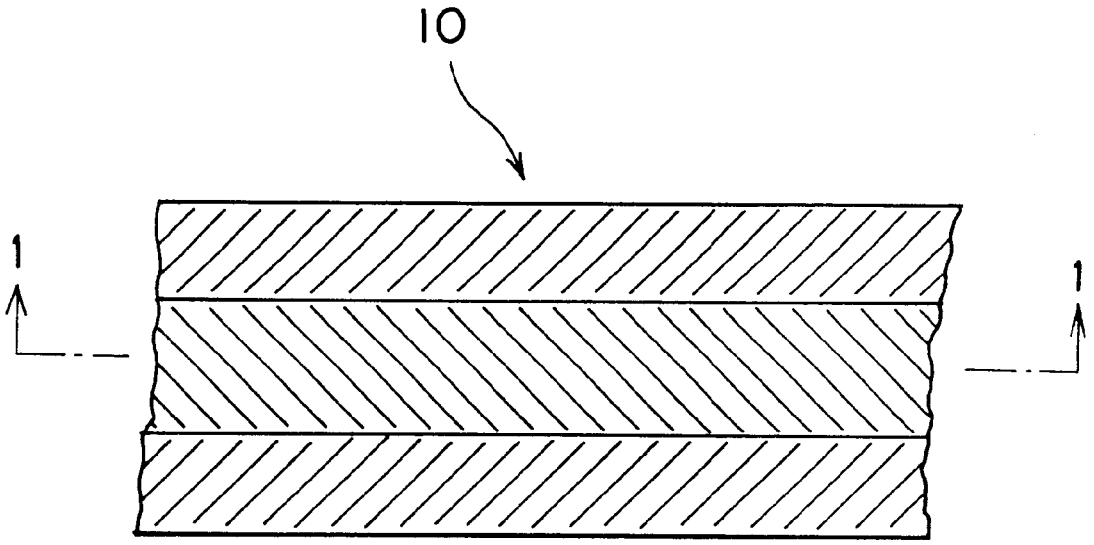
FIG. 2 shows a webbing formed with a woven structure according to a first preferred embodiment of the present invention.

FIG. 1 shows a longitudinal cross-sectional view (taken along the line 1—1 in FIG. 2) of webbing 10 formed with a woven structure according to a first preferred embodiment of the present invention. FIG. 2 shows a plan view of the webbing 10. In FIG. 1, the components are each shown exaggerated for the purposes of clarification in the following description thereof.

The webbing 10 is comprised of two kinds of warps 12 interwoven along a longitudinal direction of the webbing, and wefts 14 interwoven along a transverse direction of the webbing 10 with respect to the warps 12.

The warps 12 each include a cored yarn 16, for example, made of polyester or aramide, and a side yarn 18, for example, made of polyester. These yarns have different elongation percentages or extensional rigidities. Namely, the cored yarn 16 is formed so as to have a relatively small elongation percentage or a large extensional rigidity and is interwoven in a central portion of the webbing 10. The side yarn 18 is formed so as to have a large elongation percentage or a small extensional rigidity and is interwoven at the side of the surface of the webbing 10.

The cord yarn 16 is inserted or laid-in to the webbing 10. By contrast, the side yarn 18 is interwoven with the wefts 14.

Further, the cored yarn 16 whose elongation percentage (or extensional rigidity) is relatively smaller (or larger) than that of the side yarn 18 is twisted by, for example, "single twisting". The twisted cored yarn 16 is set such that twist coefficient $K \geqq 1200$ assuming that the number of twist per meter is T, the number of denier of the cored yarn 16 is D, and a twist coefficient defined by $T\sqrt{D}$ is K.

For example, it is preferable that the number of twist T is 110, the number of denier D is 1250, and the twist coefficient K is 3900.

The above-described webbing 10 is useful, for example, in a vehicle seat belt device. When a large load acts on the webbing 10 at the time of sudden deceleration of the vehicle, the cored yarns 16 whose elongation percentage (or extensional rigidity) is relatively small (or large) among the warps 12 breaks earlier than the side yarns 18 and absorb the load, thereby reducing energy applied to the vehicle occupant.

In the webbing 10 according to the first embodiment of the present invention, the cored yarn 16 is subjected to the twist processing, and therefore, unevenness or roughness is formed on the surface of the cored yarn 16 and the frictional force between yarns (between the cored yarn 16 and the side yarn 18 (or the weft 14)) thereby increases. The frictional force functions for preventing free movement of the twisted cored yarns 16 caused by bending of the webbing 10, or the like. Accordingly, even if the webbing 10 is bent due to applying the webbing to a vehicle occupant, the cored yarns 18 resist coming out from the surface of the webbing 10.

Further, in this case, the twisted cored yarn 16 is set so as to satisfy the expression, $K \geqq 1200$, assuming that the number of twist per meter is T, the number of denier of the warp is D, and the twist coefficient defied by $T\sqrt{D}$ is K. The frictional force between yarns is increased due to the unevenness on the surface of the cored yarn 16, thereby making it possible to reliably prevent the cored yarn 16 form coming out from the surface of the webbing.

Figure 3A:
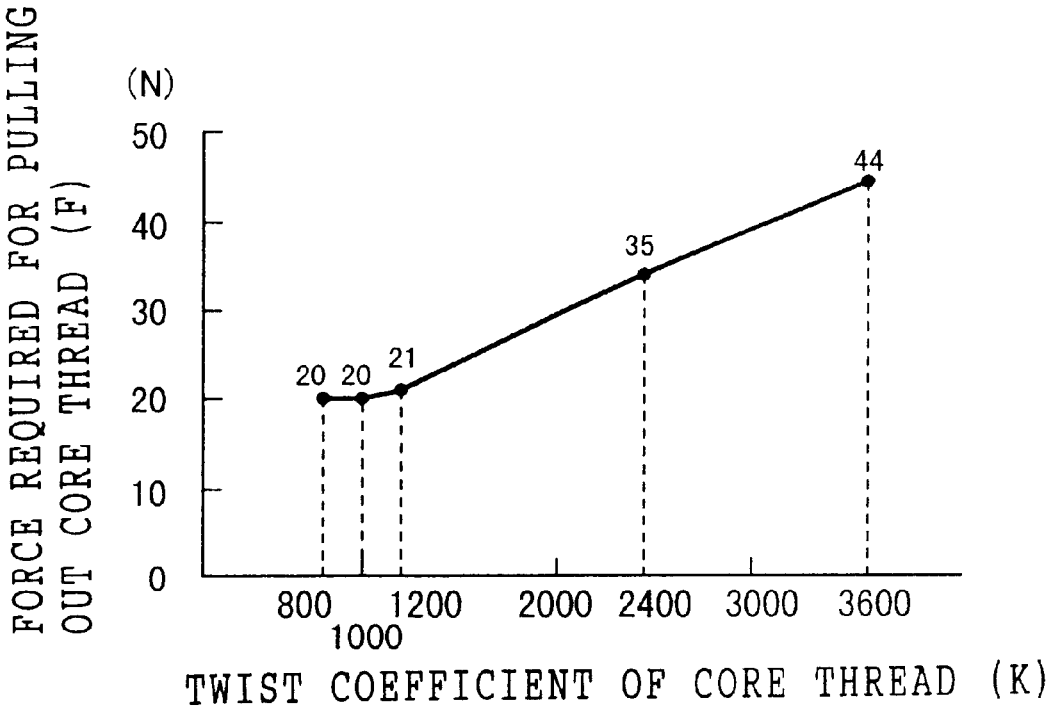
FIG. 3A is a diagram which shows data obtained by measuring the force required for pulling out cored yarns from webbing according to the first embodiment of the present invention, versus the relationship between a twist coefficient of cored yarns and the frictional force between the cored yarns in the webbing.
Figure 3B:
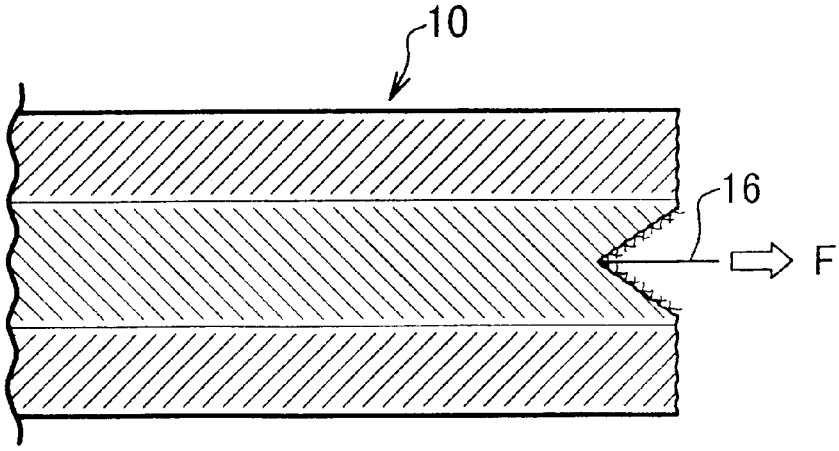
FIG. 3B is a plan view which schematically shows a method for measuring the data shown in FIG. 3A.

Here, FIG. 3A shows data obtained by measuring the frictional force between the cored yarn 16 and other yarns (the side yarn 18 or the weft 14), measured as the force F (that is, difficulty in pulling out) required for pulling out the cored yarn 16 from the webbing 10 as shown in FIG. 3B.

It can be seen from FIG. 3A that so long as the twist coefficient K is set such that $K \geqq 1200$, the force F required for pulling out the cored yarn 16 from the webbing 10 rapidly increases in proportion to K. Namely, the frictional force between the cored yarn 16 and other yarn (the side yarn 18 or the weft 14) is reliably caused to be relatively large.

As described above, in the webbing 10 (woven structure) according to the first embodiment of the present invention, there is reduced possibility that the cored yarn 16 among the interwoven yarns will come out from the surface of the webbing due to bending of the webbing caused by applying the webbing to a vehicle occupant. The result is reduced fraying of yarns and deterioration in appearance. These effects are achieved without significant reduction in the strength and energy absorptivity of the webbing.

Next, a second preferred embodiment of the present invention will be described.

Figure 4:
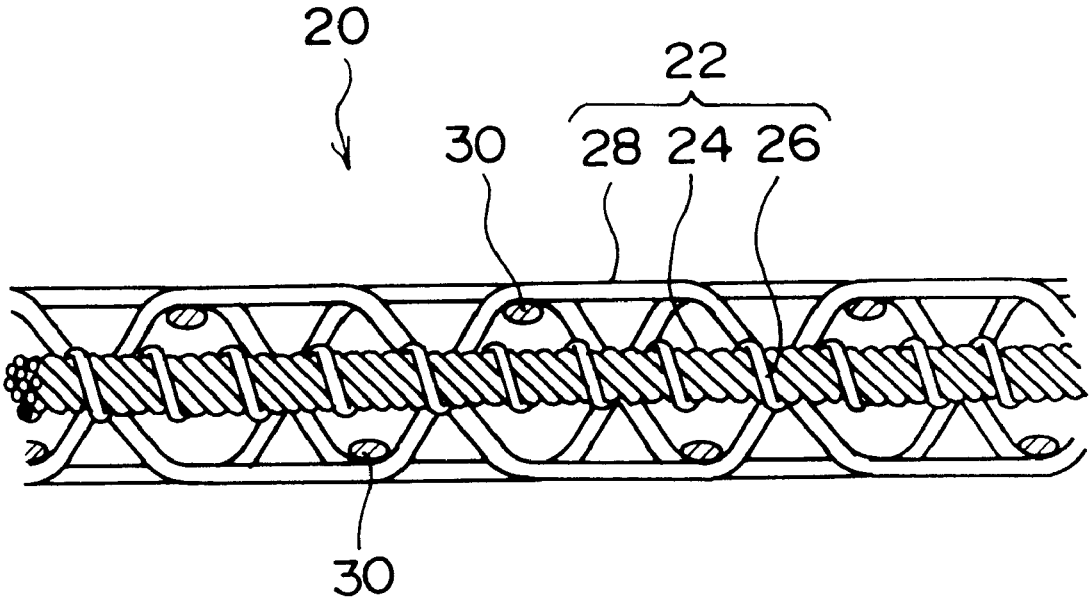
FIG. 4 is a longitudinal cross-sectional view corresponding to FIG. 1, which shows webbing formed with a woven structure according to a second preferred embodiment of the present invention.

FIG. 4 is a longitudinal cross-sectional view of webbing 20 formed with a woven structure according to the second preferred embodiment of the present invention. In FIG. 4, the components are each again shown exaggerated for the purpose of clarification in description.

The webbing 20 includes warps 22 interwoven along the longitudinal direction thereof. The warps 22 each include cored yarns 24 and 26 having different thicknesses, and a side yarn 28. The cored yarns 24 and 26, and the side yarn 28 have different elongation percentages or extensional rigidities. Namely, the cored yarns 24 and 26 are set such that the elongation percentages thereof are relatively small or the extensional rigidities thereof are relatively large, and these cored yarns are interwoven at a central portion of the webbing 20. Further, the side yarn 28 is set such that the elongation percentage thereof is relatively large or the extensional rigidity thereof is relatively small, and the side yarn is interwoven on the side of the surface of the webbing 20.

The cored yarns 24 and 26 whose elongation percentages are relatively smaller than, or whose extensional rigidities are relatively larger than, the side yarn 28 are twisted by a so-called "mixed twisting", and the thin cored yarn 26 is twisted around and into the thick cored yarn 24. The twisted cored yarns 24 and 26 are each set so that a twist coefficient K satisfies an expression, $K \geqq 1200$, assuming that the number of twist per meter is indicated by T, the number of denier of the cored yarns is indicated by D, and the twist coefficient defined by $T\sqrt{D}$ is indicated by K.

In the webbing 20 having the above-described structure, when a large load acts on the webbing 20, among the warps 22, the cored yarns 24 and 26 whose elongation percentages are relatively small or extensional rigidities are relatively large, break earlier than the side yarn 28 and absorb the load, thereby reducing the energy acting on a vehicle occupant.

In the webbing 20 according to the second embodiment of the present invention, the cored yarns 24 and 26 are subjected to twist processing, and therefore, unevenness is caused on the entire surface of the twisted cored yarns 24 and 26 so that friction between the cored yarns 24 and 26, and other yarn (the side yarn 28 or a weft 30) increases. Particularly, when two kinds of cored yarns 24 and 26 having different thicknesses are twisted, the entire surface of the cored yarns 24 and 26 becomes uneven still further. Therefore, the frictional force further increases. The frictional force functions for preventing free movement of the twisted cored yarns 24 and 26 caused by bending of the webbing 20, or the like. Accordingly, even if the webbing 20 is bent due to an operation of applying the webbing to a vehicle occupant, the cored yarns 24 and 26 have increased resistance to coming out from the surface of the webbing 20.

In this case as well, the twisted cored yarns 24 and 26 are set so as to satisfy the expression, $K \geqq 1200$, assuming that the number of twisting per meter is indicated by T, the number of denier of the warp is indicated by D, and the twist coefficient defined by $T\sqrt{D}$ is indicated by K. Therefore, friction increases between yarns due to the unevenness around substantially the entire surface of the cored yarns 24 and 26, thereby making it possible to reliably prevent the cored yarns 24 and 26 from coming out from the surface of the webbing.

As described above, in the webbing 20 (woven structure) according to the second embodiment, there is reduced possibility that the cored yarns 24 and 26 among the interwoven yarns will come out from the surface of the webbing due to bending of the webbing, or the like, caused by applying the webbing to a vehicle occupant. As a result, fraying of yarns and deterioration in appearance is reduced without significant reduction in strength or energy absorptivity of the webbing.

The above-described first embodiment is constructed in such a manner that one kind of cored yarn 16 among the warp 12 is set and subjected to twist processing. Further, the second embodiment is constructed in such a manner that two kinds of cored yarns 24 and 26 among the warp 22 are set and subjected to twist processing. However, the present invention is not limited to the foregoing, and three or more kinds of cored yarns among the warp may be set and subjected to twist processing.

As described above, the webbing woven structure according to the present invention has an advantage in that there is reduced possibility of interwoven yarns coming out from the surface of the webbing due to bending or friction caused by the webbing sliding on a through anchor or applying the webbing to a vehicle occupant. Fraying of yarns or deterioration in appearance is thus reduced, and further, this advantage is achieved without any significant decrease in the strength or energy absorptivity of the webbing.

What is claimed is:

1. A vehicle occupant restraining webbing structure comprising warps along a longitudinal direction of the webbing, and wefts interwoven along a transverse direction with respect to the warp wherein the warps include first and second types of warps, the first and second types of warps having different extensional rigidities from one another, said first type of warps being inserted among said wefts, said second type of warps being interwoven with said wefts;

wherein the first type of warps have a preselected number of twists per meter and an extensional rigidity greater than the second type of warps, and wherein the first type of warps includes a larger diameter and a smaller diameter warp, the smaller diameter warp being twisted around and into the larger diameter warp for forming a yarn located along a core of said webbing structure.

2. A woven webbing structure according to claim 1, wherein T is a number of twists per meter, D is number of denier of the first type of warps, and K is a twist coefficient defined by $K=T\sqrt{D}$, and the twist coefficient, K, for the first type of warps is at least 1200.

3. A woven webbing structure according to claim 1, wherein T is a number of twists per meter, D is a number of denier of the first type of warps, and K is a twist coefficient defined by $K=T\sqrt{D}$, and the twist coefficient, K, for the first type of warps is at least 1200.

4. A woven webbing structure according to claim 1, wherein the first type of warps are made from a material selected from a group consisting of polyester and aramid, and the second type of warps have extensional rigidities less than those of the first type of warps.

5. A vehicle occupant restraining woven webbing structure for use in a safety restraint belt device, the webbing structure comprising:

(a) groups of first and second side yarns having an extensional rigidity and oriented along the length of said webbing structure;

(b) a longitudinally oriented yarn located along a core of said webbing structure and centrally disposed between each group of first and second side yarns, the core-located longitudinal yarn being formed from a plurality of yarns twisted around one another, wherein the core-located longitudinal yarn has an extensional rigidity different from the first yarns; and (c) crosswise strands transverse to said first and second side yarns and said longitudinal yarn, wherein said longitudinally oriented core-located yarn is inserted among said crosswise strands and said first and second side yarns are interwoven with said crosswise strands, wherein each core-located longitudinal yarn includes a plurality of a first type of yarns twisted around one another, and a second type of yarn, having a smaller diameter than the first type of yarn, twisted around the plurality of the first type of yarns.

6. A woven webbing structure according to claim 5, wherein T is a number of twists per meter, D is a denier number of the yarns, and K is a twist coefficient defined by $K=(T)(K^{1/2})$, wherein K is at least 1200 for the cored longitudinal yarn.

7. A woven webbing structure according to claim 5, wherein the first and longitudinal cored yarns are made from polyester.

8. A woven webbing structure according to claim 5, wherein the first and longitudinal core-located yarns are made from aramid.

9. A method of forming a safety restraint belt from a woven webbing structure, the method comprising the steps of:

(a) forming groups of first and second side yarns having an extensional rigidity along a length of said belt;

(b) forming a longitudinally oriented core-located yarn centrally disposed between each group of first and second side yarns, the core-located longitudinal yarn being formed by twisting a plurality of yarns around one another, wherein the core-located longitudinal yarn has an extensional rigidity different from the first yarns; and (c) transversely interweaving crosswise strands only among said first and second side yarns such that said longitudinal yarn is inserted within the webbing structure, wherein the step of forming a longitudinally oriented core-located yarn further includes twisting another yarn around said plurality of twisted yarns, wherein said another yarn has a smaller diameter than the yarns forming said plurality of yarns.

10. A method of forming a safety restraint belt from the woven webbing structure according to claim 9, wherein the step of forming a longitudinally oriented cored yarn includes twisting the plurality of yarns around one another to achieve a twist coefficient of at least 1200.

11. A method of forming a safety restraint belt from the woven webbing structure according to claim 9, wherein the yarns are formed of polyester.

12. A method of forming a woven webbing structure according to claim 9, wherein the yarns are formed of aramid.

13. A method of forming a safety restraint belt from the woven webbing structure according to claim 9, further comprising the step of selecting first side yarns so as to have an extension rigidity less than the cored longitudinal yarns.

14. A woven webbing structure manufactured according to the method according to claim 9.

15. A vehicle occupant restraining webbing structure comprising warps along a longitudinal direction of the webbing, and wefts interwoven along a transverse direction with respect to the warps, wherein the warps include first and second types of warps, the first and second types of warps having different extensional rigidities from one another, said first type of warps being inserted among said wefts, said second type of warps being interwoven with said wefts;

wherein the first type of warps have a preselected number of twists per meter and an extensional rigidity greater than the second type of warps;

wherein T is a number of twists per meter, D is a number of denier of the first type of warps, and K is a twist coefficient defined by $K=T\sqrt{D}$, and the twist coefficient, K, for the first type of warps is at least 1200, and wherein the first type of warps include a larger diameter and a smaller diameter warp.

* * * * *